US006789520B2

(12) United States Patent
Saito

(10) Patent No.: US 6,789,520 B2
(45) Date of Patent: Sep. 14, 2004

(54) SYSTEM FOR CRANKING INTERNAL COMBUSTION ENGINE

(75) Inventor: Mikio Saito, Motosu-gun (JP)

(73) Assignee: Denso Corporation, Kariya (JP)

( * ) Notice: Subject to any disclaimer, the term of this patent is extended or adjusted under 35 U.S.C. 154(b) by 53 days.

(21) Appl. No.: 10/206,037

(22) Filed: Jul. 29, 2002

(65) Prior Publication Data

US 2003/0051691 A1 Mar. 20, 2003

(30) Foreign Application Priority Data

Sep. 17, 2001 (JP) ..... 2001-280890

(51) Int. Cl.[7] ..... F02N 17/00
(52) U.S. Cl. ..... 123/179.3; 290/38 R
(58) Field of Search ..... 123/179.3, 179.2, 123/179.4; 290/38 R, 38 C, 38 D, 38 E, 37 A

(56) References Cited

U.S. PATENT DOCUMENTS 3,629,598 A * 12/1971 Rachel ..... 290/38 R
3,632,916 A * 1/1972 Schaad ..... 200/43.03
3,643,004 A * 2/1972 McKean ..... 174/36
3,863,077 A * 1/1975 Bienkowski ..... 290/38 R
4,292,483 A * 9/1981 Roytberg ..... 200/43.03
5,564,375 A * 10/1996 Orzal ..... 123/179.3
5,742,137 A * 4/1998 Bratton et al. ..... 318/139
5,936,316 A * 8/1999 Jurkiewicz et al. ..... 307/10.6
2003/0067172 A1 * 4/2003 Niimi ..... 290/38 R

FOREIGN PATENT DOCUMENTS

JP 57-36763 of 1982
JP 6-37567 5/1994

OTHER PUBLICATIONS

U.S. patent application/Attorney Docket No. 113326, Niimi, filed Jul. 24, 2002.

* cited by examiner

*Primary Examiner*—Mahmoud Gimie
*Assistant Examiner*—Arnold Castro
(74) *Attorney, Agent, or Firm*—Oliff & Berridge, PLC

(57) ABSTRACT

A system for cranking an internal combustion engine includes an electric starter and a current supply circuit having a key switch. By turning on the key switch, the starter is rotated to crank the engine. To avoid an inadvertent restart of the starter while the engine is running, a locking device that prohibits the inadvertent turning-on of the key switch is provided in the system. A starter relay may be included in the current supply circuit. The starter relay is kept open even if the key switch is turned on when the engine is running to prohibit the inadvertent restart of the starter.

8 Claims, 3 Drawing Sheets

SYSTEM FOR CRANKING INTERNAL COMBUSTION ENGINE

CROSS-REFERENCE TO RELATED APPLICATION

This application is based upon and claims benefit of priority of Japanese Patent Application No. 2001-280890 filed on Sep. 17, 2001, the content of which is incorporated herein by reference.

BACKGROUND OF THE INVENTION

1. Field of the Invention

The present invention relates to a starter system for cranking an internal combustion engine.

2. Description of Related Art

An inertia-engagement-type starter motor having a pinion that engages with a ring gear of an internal combustion engine by its own inertia has been widely used. A rotational torque of an electric motor is transmitted to the pinion engaging with the ring gear thereby to crank up the engine. After the engine is cranked up, the pinion is disengaged from the ring gear and returned to its original position.

Another type of starter motor, a so-called rotation-restricted-engagement-type starter motor is also known. An example of this type of starter motor is disclosed in JP-U-57-36763. A pinion of this type of starter motor is coupled to an output shaft of an electric motor via a helical spline formed on the output shaft. Rotation of the pinion is restricted to push forward the pinion thereby to establish its engagement with the ring gear of the engine.

There has been a problem, however, both in the inertia-engagement-type starter and in the rotation-restricted-engagement-type starter. In the inertia-engagement-type starter, when a driver inadvertently restarts the starter, the pinion abuts the ring gear rotating at a high speed without being able to engage with the ring gear. Therefore, a high impact noise is generated at the abutment, and the pinion or the ring gear may be damaged.

The problem is more serious in the rotation-restricted-engagement-type starter. When the starter is inadvertently restarted while the engine is running, the pinion which is unable to engage with the ring gear is forcibly rotated while its rotation is restricted by a restricting member. Therefore, it is highly possible that the restricting member and its associated components are damaged by the forcible rotation of the pinion. To avoid this problem, it may be necessary to provide the restricting member with a higher strength, which makes the size of the restricting member larger.

SUMMARY OF THE INVENTION

The present invention has been made in view of the above-mentioned problem, and an object of the present invention is to provide an improved starter system in which the inadvertent restart of the starter is automatically prevented.

The starter system for cranking an internal combustion engine includes a starter having an electric motor, and a starter circuit for supplying electric current to the starter. A key switch that is closed by turning on an ignition switch is connected in the starter circuit, and current is supplied to the starter by closing the key switch.

A pinion of the starter is engaged with a ring gear of the engine by inertia of the pinion in an inertia-engagement-type starter. In a rotation-restricted-engagement-type starter, rotation of the pinion which is coupled to an output shaft of the starter via a helical spline is restricted by a rotation-restricting member. The rotation-restricted pinion is pushed forward to engage with the ring gear.

In the case where the inertia-engagement-type starter is used in the system, the pinion cannot engage with the ring gear when a driver inadvertently restarts the starter while the engine is running. High impact noises are generated by abutment of the pinion against the ring gear, and the pinion and/or the ring gear may be damaged. In the case where the rotation-restricted-engagement-type starter is used in the system, the member restricting the pinion rotation is forcibly rotated by the pinion which is unable to engage with the ring gear. As a result, the restricting member may be damaged.

In order to avoid the above problem, a locking device that prevents the inadvertent restart of the starter when the engine is running is provided in the key switch. The ignition key is prevented from being turned on to restart the starter by the locking device when rotation of the engine is detected. Alternatively, a starter relay is provided in the starter circuit for supplying current to the starter, and the starter relay is controlled to be kept open, even if the key switch is closed to restart the starter when the engine is running. The operation of the locking device and the starter relay may be controlled by an electronic control unit.

According to the present invention, possible damages of the pinion or the rotation-restricting member, which are caused by the inadvertent restart of the starter when the engine is running, are prevented by adding a simple device or structure in the starter system.

Other objects and features of the present invention will become more readily apparent from a better understanding of the preferred embodiments described below with reference to the following drawings.,

DETAILED DESCRIPTION OF THE PREFERRED EMBODIMENTS

Figure 1:
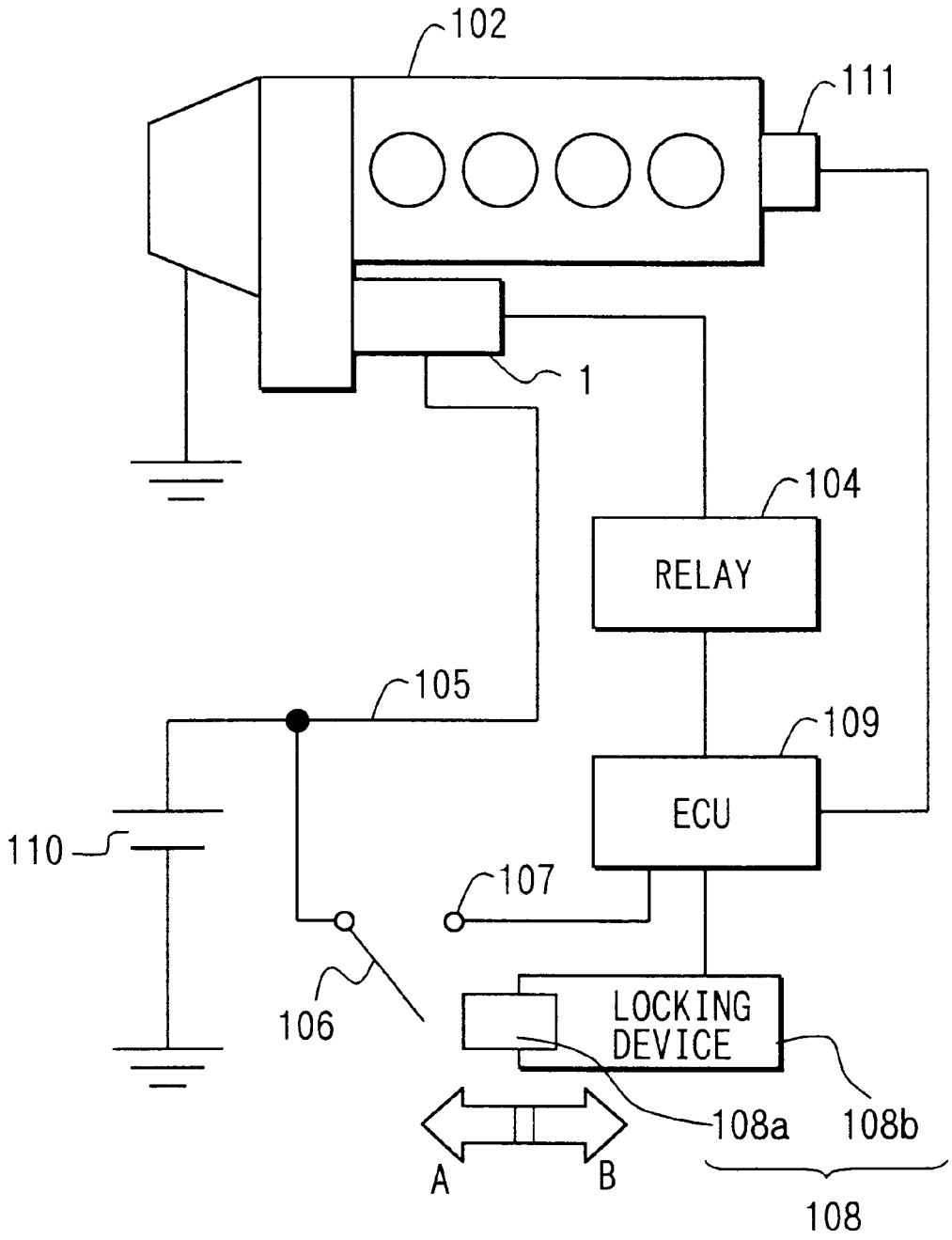
FIG. 1 is a block diagram showing a starter system according to the present invention.

Preferred embodiments of the present invention will be described with reference to accompanying drawings. First, referring to FIG. 1, an entire starter system will be described. An internal combustion engine 102 is cranked up by a starter system to which electric power is supplied from an on-board battery 110. The starter system includes: a starter 1; a current-supply circuit 105 for supplying current to the starter 1 through a starter relay 104; a locking device 108 for prohibiting turning-on of an ignition key 106 when the engine is running, i.e., when rotational speed of the engine is not zero; and an electronic control unit 109 for controlling operation of the starter system.

A key switch composed of an ignition key 106, a starter terminal 107 and the locking device 108 is connected to the current supply circuit 105 as shown in FIG. 1. Upon turning on the ignition key 106 (i.e., when a circuit between the ignition key 106 and the starter terminal 107 is closed), the starter relay 104 is closed by the electronic control unit 109 thereby to supply current to the starter 1.

The locking device 108 includes a locker 108*a* and an electromagnetic actuator 108*b* for driving the locker 108*a*. The electromagnetic actuator 108*b* drives the locker 108*a* in the direction "A—B" shown in FIG. 1. When the locker 108*a* is driven to the position A, the ignition key 106 is mechanically prevented from contacting the starter terminal 107. When the locker 108*a* is driven to the position B, the ignition key 106 becomes freely operable. The electronic control unit 109 having a microcomputer therein controls operation of the starter relay 104 and the locking device 108.

Figure 2:
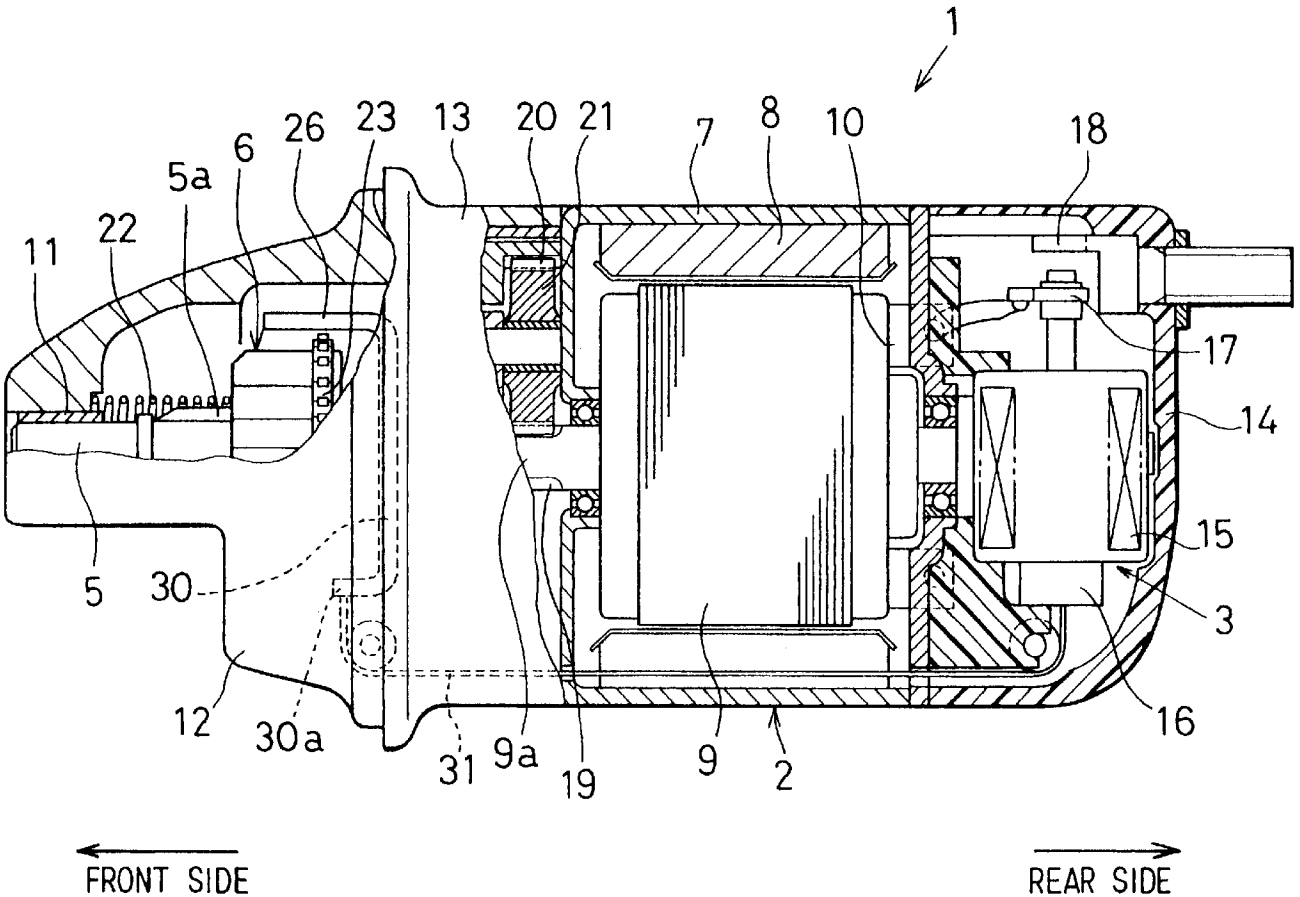
FIG. 2 is a cross-sectional view showing an example of a rotation-restricted-engagement-type starter used in the system shown in FIG. 1.

The starter 1 is a starter such as a rotation-restricted-engagement-type starter, an example of which is shown in FIG. 2. The starter 1 will be described in detail with reference to FIG. 2. The starter 1 is composed of: an electric motor 2 generating a rotational torque; an electromagnetic switch 3 for switching on and off electric current supplied to the electric motor 2; an output shaft 5 disposed coaxially with an armature shaft 9*a*; a speed reduction device for reducing rotational speed of the electric motor 2; an one-way clutch (a known type, not shown in FIG. 2) disposed between the speed reduction device and the output shaft 5; a pinion 6 coupled with the output shaft 5; and means for restricting rotation of the pinion 6. The restricting means will be described later in detail.

The electric motor 2 is a known type of a direct current motor having a yoke 7, a field permanent magnet 8, an armature 9, brushes 10 and other associated components. Electric current is supplied to the armature 9 through the brushes 10 when a current supply circuit is closed by the electromagnetic switch 3. The output shaft 5 is rotatably supported at its front end by a bearing 11 disposed in a front housing 12 and at its rear end by a bearing (not shown) disposed in a center case 13. A helical spline 5*a* is formed on the output shaft 5. The center case 13 is interposed between the front housing 12 and the yoke 7 of the electric motor 2 and covers an outside of the speed reduction device.

The electromagnetic switch 3 is disposed at the rear side of the starter and is covered with a rear end frame 14. The electromagnetic switch 3 includes a coil 15 energized by electric current supplied thereto, a plunger 16 slidably disposed inside the coil 15, and a movable contact 17 connected to the plunger 16. When the plunger 16 is pulled by a magnetic force of the coil 15, the movable contact 17 carried by the plunger 16 abuts a pair of stationary contacts 18 fixed to the rear end frame 14 thereby to close the stationary contacts 18. Upon closing the stationary contacts 18, electric current is supplied to the electric motor 2.

The speed reduction device is a planetary gear speed reduction device composed of: a sun gear 19 formed at a front end of the armature shaft 9*a*; a ring-shaped internal gear 20; and plural planetary gears 21 engaging with both of the sun gear 19 and the internal gear 20. As the sun gear 19 is rotated by the armature 9, the planetary gears 21 rotate around their own axes and at the same time orbit around the sun gear 19. The orbital rotation speed of the planetary gears 21 is slower than the rotational speed of the armature 9. That is, the rotational speed of the armature 9 is reduced by the speed reduction device and is transmitted to the one-way clutch.

The pinion 6 engages with a ring gear of an engine to crank up the engine. The pinion 6 is coupled to the output shaft 5 via a helical spline 5*a* formed on the output shaft 5. The pinion 6 is pushed forward along the helical spline 5*a* and is returned by a biasing force of a spring 22.

Now, means for restricting rotation of the pinion 6 will be described. The restricting means is composed of an annular member 23 formed integrally with the pinion 6 and a rod member 26. An outer diameter of the annular member 23 is made larger than an outer diameter of the pinion 6. Plural arc-shaped depressions are formed on the outer periphery of the annular member 23, and the rod member 26 engages with one of the depressions to restrict the pinion rotation.

The rod member 26 engaging with the depressions is formed by bending one end of a circular rod 30, as shown in FIG. 2. The rod member 26 is positioned outside of the annular member 23 when it is not engaged with the depression of the annular member 23. The rod member 26 is brought to a position to engage with the depression by a mechanism described below. The rod member 26 is released from the depression after the pinion 6 is pushed forward to a position where the pinion 6 completely engages with the ring gear. The axial length of the rod member 26 is made to cover the axial movement of the pinion 6.

The circular rod 30, as shown in FIG. 2, is disposed in the starter 1, so that it is movable up and down in the radial direction of the pinion 6 while its movement in the axial direction is restricted. The other end 30*a* of the circular rod 30 is connected to the plunger 16 of the electromagnetic switch 3 with a wire 31, and the circular rod 30 is biased upward by a return spring (not shown). When the plunger 16 is pulled upward by the coil 15, the circular rod 30 is pulled down by the wire 31 against the biasing force of the return spring. When the pulling force of the coil 15 disappears upon termination of current supply to the coil 15, the circular rod 30 is returned to its original position by the biasing force of the return spring.

Operation of the pinion rotation restricting means described above will be explained. Upon energizing the coil 15, the plunger 16 is pulled in by the coil 15. The circular rod 30 is pulled down by the wire 31 connected to the plunger 16, and thereby the rod member 26 of the circular rod 30 engages with one of the depressions formed on the outer periphery of the annular member 23 to restrict rotation of the pinion 6. Then, the movable contact 17 carried by the plunger 16 abuts the stationary contacts 18, thereby forming a circuit for supplying current to the armature 9 of the electric motor 2.

When the armature 9 rotates, the rotational torque of the armature 9 is transmitted to the output shaft 9 via the speed reduction device and the one-way clutch. The rotational speed of the armature 9 is reduced by the speed reduction device. As the output shaft 5 rotates, the pinion 6 coupled to the out put shaft 5 via the helical spline 5*a* is pushed forward by a thrust force generated by restricting the rotation of the pinion 6. The pinion 6, rotation of which is restricted, is pushed forward until it abuts an end surface of the ring gear. Because the axial movement of the pinion 6 is once stopped by abutting the ring gear, the pinion 6 coupled to the output shaft 5 via the helical spline 5*a* is forcibly rotated by the output shaft 5 against a resilient force of the circular rod 30. As the pinion 6 is forcibly rotated to a position where the pinion 6 is able to engage with the ring gear, the pinion 6 moves forward again until the pinion 6 completely engages with the ring gear.

When the complete engagement is established, the rod member 26 is separated from the depression of the annular member 23 thereby to release the rotation restriction of the pinion 6. As the pinion 6 is released from the restriction, the pinion 6 engaging with the ring gear is rotated by the output shaft 5 thereby to crank up the engine. The rod member 26 separated from the depression is positioned behind the rear surface of the annular member 23 to restrict a backward movement of the pinion 6.

When current supply to the coil 15 is terminated after the engine is cranked up, the pulling force of the coil 15 disappears. The plunger 16 returns to its original position (the position shown in FIG. 2) by a biasing force of a return spring (not shown). The movable contact 17 is separated from the stationary contacts 18 thereby to terminate current supply to the armature 9 and to stop the armature rotation. As t he plunger 16 returns to its original position, the tension applied to the wire 31 from the plunger 16 is released, and the circular rod 30 connected to the wire 31 returns to its original position (the position shown in FIG. 2) by the biasing force of the return spring. The rod member 26 positioned behind the annular member 23 also returns to its original position, removing the restriction of backward movement of the pinion 6. The pinion 6 moves backward and returns to its original position by the biasing force of the spring 22.

Figure 3:
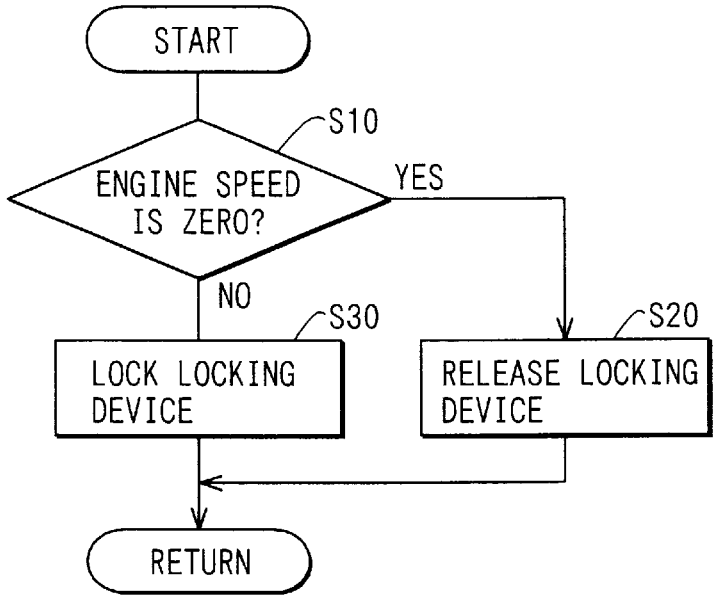
FIG. 3 is a flowchart showing a process of controlling operation of a key switch, as a first embodiment of the present invention.

Now, a process of controlling the locking device 108, as a first embodiment of the present invention, will be described with reference to FIG. 3. At step S10, whether the engine is not running (i.e., whether rotational speed of the engine is zero) is determined. The engine speed for this determination is fed from a rotational speed sensor 111 shown in FIG. 1. If the engine is not running, the process proceeds to step S20, where the locking device 108 is released, i.e., the locker 108*a* is brought to the position B so that the ignition key 106 becomes freely operable.

If the engine is running, the process proceeds to step S30, where the locking device 108 is locked, i.e., the locker 108*a* is brought to the position A so that the ignition key 106 cannot be turned. That is, when the engine is running, the ignition key 106 is locked to prevent an inadvertent restart of the starter 1 even if a driver tries to operate the ignition key 106. In this manner, the starter 1 is prohibited from being restarted when the engine is running (when the engine speed is not zero).

In the case where the inertia-engagement-type starter is used in the starter system, the pinion and/or the ring gear of the engine are prevented from being damaged by the inadvertent restart of the starter. It is especially important, in the case where the rotation-restricted-engagement-type starter is used in the starter system, to prevent the rotation-restricting means including the annular member 23 and the rod member 26 from being damaged by the inadvertent restart of the starter. The rotation-restricting means is effectively protected by prohibiting the ignition key operation when the engine is running.

Figure 4:
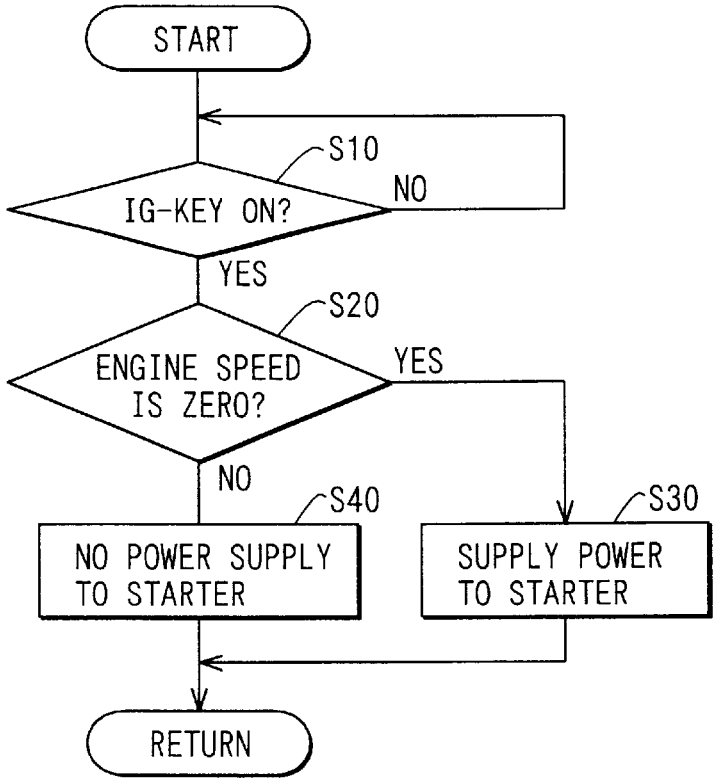
FIG. 4 is a flowchart showing a process of controlling a starter relay, as a second embodiment of the present invention.

A process of controlling the starter relay 104, as a second embodiment of the present invention, will be described with reference to FIG. 4. In this process, the starter relay 104 is kept open when the engine is running even if a driver tries to close the key switch. At step S10, whether the ignition key 106 is turned on is determined. If the ignition key 106 is turned on, the process proceeds to step S20, where whether the engine is not running (i.e., whether the engine speed is zero) is determined. The signal from the rotational speed sensor 111 is used for this determination. If the engine is not running, the process proceeds to step S30, where the starter relay 104 is closed to supply current to the starter 1 thereby to crank the engine.

If the engine is running, the process proceeds to step S40, where the starter relay 104 is kept open to prohibit current supply to the starter 1. In this manner, the starter is prevented from being damaged by the inadvertent restart of the starter when the engine is running.

While the present invention has been shown and described with reference to the foregoing preferred embodiments, it will be apparent to those skilled in the art that changes in form and detail may be made therein without departing from the scope of the invention as defined in the appended claims.

What is claimed is:

1. A system for cranking an internal combustion engine, the system comprising:

starter including a pinion that engages with a ring gear of the internal combustion engine for cranking the internal combustion engine, the pinion being coupled to an output shaft of the starter via a helical spline formed on the output shaft rotation of the pinion being restricted for pushing the pinion in its axial direction for establishing engagement between the pinion and the ring gear;

an electrical circuit for supplying current to the starter; and a key switch connected to the electrical circuit, the key switch being adapted to be closed by turning on an ignition key thereby to start the starter for cranking the internal combustion engine, wherein:

the key switch includes a locking device for prohibiting turning-on of the ignition key when rotational speed of the internal combustion engine is other than zero.

2. A system for cranking an internal combustion engine, the system comprising:

a starter;

a starter relay through which electric current is supplied to the starter upon closing the starter relay;

an ignition key adapted to start the starter by turning on the ignition key; and an electronic control unit for controlling operation of the starter relay, wherein:

the electronic control unit prohibits closing of the starter relay when the rotational speed of the internal combustion engine is other than zero, the starter includes a pinion that engages with a ring gear of the internal combustion engine for cranking the same, the pinion being coupled to an output shaft of the starter via a helical spline formed on the output shaft; and rotation of the pinion is restricted for pushing the pinion in its axial direction for establishing engagement between the pinion and the ring gear.

3. A starter system for an internal combustion engine, comprising:

a switch manually operable in an ON-direction with operating force of an operator for the internal combustion engine, the switch generating a signal to activate a starter when the switch is operated in the ON-direction;

a locking device operable between a locked position where the locking device mechanically prevents the switch from being manually operated in the ON direction and a released position where the locking device allows the switch to be manually operated in the ON-direction;

a sensor mounted on the internal combustion engine, the sensor outputting a signal indicative of whether or not the internal combustion engine is running; and a control unit connected with the locking device and the sensor, wherein the control unit drives the locking device to the locked position when the signal from the sensor indicates that the internal combustion engine is running, in order to prevent the starter from being inadvertently restarted after the internal combustion engine is rotated by an activation of the starter.

4. The starter system according to claim 3, wherein the control unit further drives the locking device to the released position when the signal from the sensor indicates that the internal combustion engine is not running, thereby the switch is prevented from being manually operated in the ON-direction only when the internal combustion engine is running, and the operator who tried to operate manually the switch in the ON-direction can realize that the engine is still running and the starter should not be activated.

5. The starter system according to claim 4, wherein the sensor is a rotational speed sensor for the internal combustion engine, the rotational speed sensor outputting a signal indicative of zero rotational speed that corresponds to the signal indicative of that the internal combustion engine is not running.

6. The starter system according to claim 5, wherein the locking device includes a locker movable between the locked position where the locker blocks operation of the switch in the ON-direction and the released position where the locker allows operation of the switch in the ON-direction and an actuator that drives the locker to either the locked position and the released position.

7. The starter system according to claim 6, further comprising a relay that supplies power to the starter in response to a signal from the control unit, wherein the control unit generates the signal to the relay when the switch is fully operated in the ON-direction.

8. The starter system according to claim 7, wherein the starter is a rotation-restricted-engagement-type, the starter including a motor that rotates an output shaft, a pinion that is coupled with the output shaft via a helical spline, and a rotation restricting member that restricts rotation of the pinion in order to propel the pinion by rotation of the output shaft and the helical spline toward a ring gear of the internal combustion engine and to establish engagement with the ring gear.

* * * * *